US005149930A

United States Patent [19]

Levoska et al.

[11] Patent Number: 5,149,930

[45] Date of Patent: Sep. 22, 1992

[54] MICROWAVE OVEN WITH LAMP AND MICROWAVE SEAL

[75] Inventors: Ilmari Levoska, Åby; Ove R. Fredriksson, Söderköping, both of Sweden

[73] Assignee: Whirlpool International B.V., Eindhoven, Netherlands

[21] Appl. No.: 556,783

[22] Filed: Jul. 11, 1990

[30] Foreign Application Priority Data

Jul. 18, 1989 [SE] Sweden ..... 8902556

[51] Int. Cl.[5] ..... H05B 6/76

[52] U.S. Cl. ..... 219/10.55 R; 219/10.55 D; 362/92

[58] Field of Search ..... 219/10.55 R, 10.55 E, 219/10.55 D; 362/92, 94

[56] References Cited

U.S. PATENT DOCUMENTS 3,604,783 9/1971 Roth ..... 219/10.55 R
4,559,585 12/1985 Almagren et al. ..... 219/10.55 R
4,621,180 11/1986 Kristof et al. ..... 219/10.55 R
4,814,952 3/1989 Hammerl ..... 362/92
4,853,508 8/1989 Hammerl ..... 219/10.55 D
4,880,955 11/1989 Nitzinger et al. ..... 219/10.55 R

FOREIGN PATENT DOCUMENTS 3643307 6/1988 Fed. Rep. of Germany .
3643364 7/1988 Fed. Rep. of Germany .
3703937 8/1988 Fed. Rep. of Germany .
3641420 9/1988 Fed. Rep. of Germany .

*Primary Examiner*—Philip H. Leung
*Attorney, Agent, or Firm*—Thomas J. Roth; Stephen D. Krefman; Thomas E. Turcotte

[57] ABSTRACT

A microwave oven with a lighting device for illumination of the oven cavity. The lighting device comprises a smaller hole in the cavity wall, the small dimensions of said hole substantially eliminating leak of microwave through the hole, and a light-intensive glowlamp which is smaller than the hole and whch is positioned outside the cavity in close connection with the hole.

10 Claims, 1 Drawing Sheet

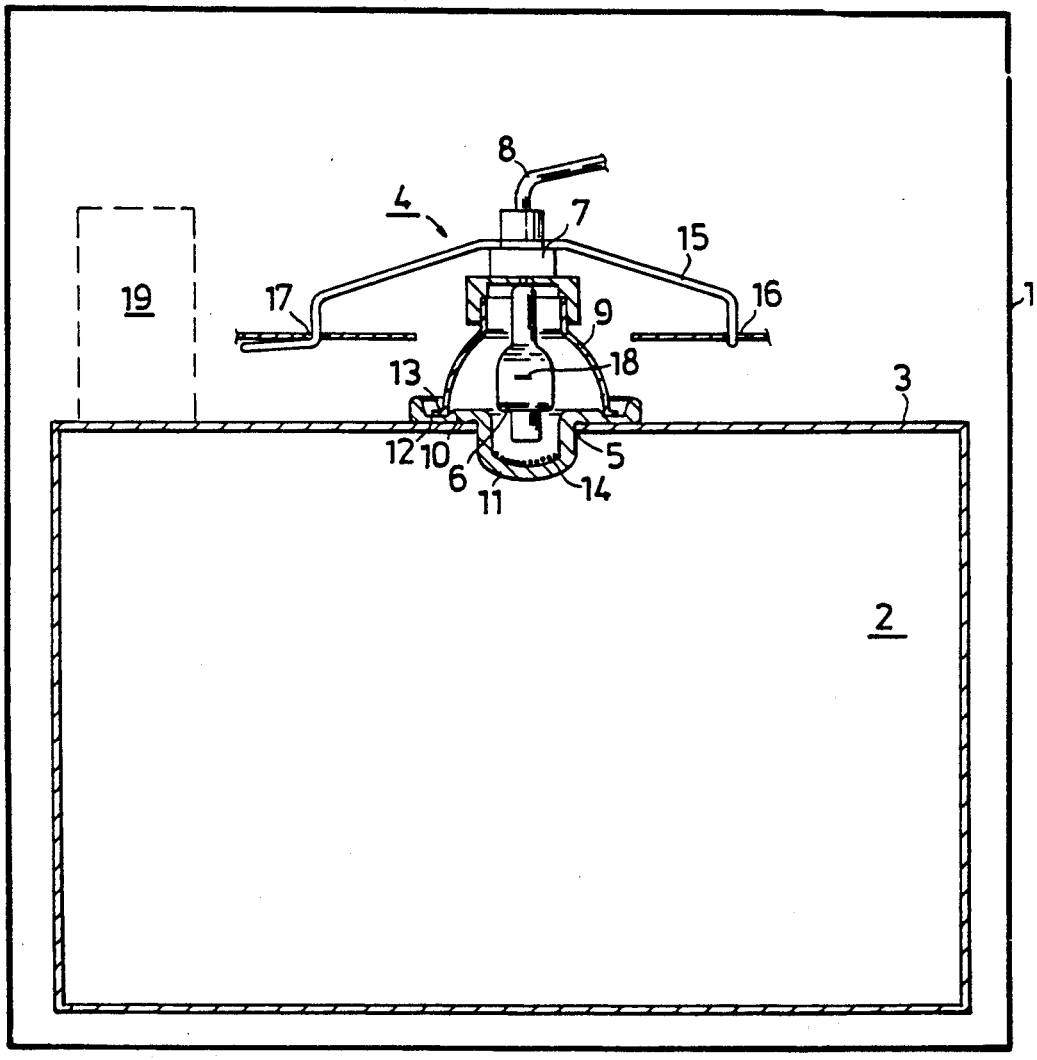
8
4
7
15
19
17
16
1
9
18
13
3
12
10
5
6
14
11
2

MICROWAVE OVEN WITH LAMP AND MICROWAVE SEAL

FIELD OF THE INVENTION

The invention is directed to a microwave oven comprising an oven cavity enclosed by a cavity wall, a microwave source for feeding microwave energy of a substantially uniform wavelength into said cavity, and a lighting device for illumination of the cavity, said lighting device comprising a light source arranged at the cavity wall and a microwave seal substantially preventing leakage of microwaves to the external surroundings of the cavity through said lighting device.

BACKGROUND OF THE INVENTION

Ovens having lighting devices are known of many different shapes, partly ovens in which only microwave energy is used, partly so called combi-ovens in which hot air as well as specific grill elements are used. The expression microwave oven in the following is intended to cover ovens in general in which microwaves are used.

In a microwave oven the lighting device is usually provided in the roof of the cavity or in any one of its side walls. As a light source a kind of lamp or light bulb is arranged in a fitting in the cavity wall.

Lighting devices of this type must comply with a number of requirements. It must provide an even lighting of the complete cavity of desirable light intensity. Additionally lamp fitting in the cavity wall must not permit more than negligible leakage of microwaves from the cavity. Under all circumstances said leakage must be well below the limits set up by authorities in different countries.

Leakage should also be minimized since leaking microwaves may also disturb the control electronics of the microwave oven. The lamp fitting and the lamp itself may only influence the microwave field distribution in the cavity to a negligible degree, because an even field distribution is of prime importance for satisfactory cooking results. A sufficient life time of the lamp must be guaranteed, which demands a specific shape of the filament in order to minimize its antenna function with respect to microwaves and thereby its possibility of being excited by the same, or, alternatively, the lamp should be protectively positioned so that the filament is reached only by a small amount of the microwaves. The heat radiation of the lamp must be limited to avoid disturbing surrounding components, which may be a problem if, for example, the lamp is arranged behind a protecting perforated plate, requiring a more powerful light source and consequently a higher electric power and heat radiation. The lamp and the lamp fitting should occupy a space which is as small as possible both inside and outside the cavity. In general the lighting device should be suitable for production at low cost, among other things by requiring the least possible change of the cavity wall and the use of a standard type lamp.

In so called combi-ovens with a grill element the temperatures in the vicinity of the grill elements may amount to 300°–400° C. The lighting device must then withstand such temperature levels.

Prior art lighting devices for microwave oven comply with some of the listed requirements, some of them to a certain degree, others not at all. For example:

DE-A-36 41 420 discloses a lighting device in which the lamp is positioned in a hole in the cavity wall by means of a metal carrier provided on the outside of the cavity. In order to minimize the microwave leak through said hole and carrier a specific sleeve of metal net is provided around the lamp. In comparison with the requirements discussed above, it may be concluded among other things that the lighting device is of a relatively complicated construction and that the associated metal carrier demands considerable space outside the cavity.

DE-A-36 43 307 discloses a lighting device in which the lamp is surrounded by a sleeve of a paramagnetic material. The lamp is arranged in a so called lamp housing provided on the outside of the cavity wall. Inwardly, the cavity, the lamp, and lamp housing is covered by a protective glass. The protective glass and its fitting into the cavity wall generate microwave field disturbances and some microwave leakage through the lamp housing. The purpose of said paramagnetic sleeve is to minimize said disturbances and leakage. Similar to the construction described above relative to DEA-3641420, the lighting device of this patent is also complicated and space demanding.

DE-A-36 43 364 which corresponds to U.S. Pat. No. 4,814,952 discloses a lighting device of which the lamp is carried by a lamp fitting arranged on the inside of the cavity wall, said fitting being in some embodiments sunk into a recess in the cavity wall. The lamp protrudes as a hole into the cavity and is covered by a protective glass. The protruding position of the lamp means that the filament as well as the supporting legs thereof must be dimensioned in relation to the wavelength of the microwaves in order not to start glowing under influence from the microwaves. Accordingly, this construction puts specific demands on the shaping of the lamp. The position of the lamp in the cavity in combination with the recessed positioning of its socket in the cavity wall will influence the field distribution in the cavity.

EP-B-120 536 discloses a lighting device in which the lamp is arranged in a so called wave guide sleeve at a hole in the cavity wall. The sleeve as well as the position of the filament in the same are so selected that microwave leakage from the cavity through the hole in the cavity wall is minimized to an acceptable level. As a whole this construction is relatively complicated and space demanding. A similar construction is disclosed in U.S. Pat. No. 2 526 226 including a tube having a cut-off wavelength which is below the wavelength of the microwaves. This construction also is relatively complicated and space demanding.

DE-A-3 703 937 discloses a further construction including a cage mounted in the cavity wall for accommodating the lamp. This disclosure specifically underlines the problem to safeguard a good metallic contact between the cage and the cavity wall, and thereby also demonstrates the drawbacks involved with the use of sealing means like said cages, tubes and sleeves.

SUMMARY OF THE INVENTION

An object of invention is to provide a microwave oven of the type mentioned in the first paragraph having a lighting device without the drawbacks of the prior art constructions and essentially fullfilling the requirements set up above.

The object is obtained by a microwave oven which is characterized in that the microwave seal is obtained by means of an opening preferably a circular hole, in the cavity wall of a selected smaller size in relation to the wavelength of the microwaves which is such that the dimensioning of the hole substantially prevents passage of microwaves through the hole, and in that said light source comprises a light-intensive lamp positioned outside the cavity, having a short filament and small dimensions relative to the hole, and being arranged in close profimity to the hole.

The lighting device according to the invention fullfils the necessary requirements and provides an even illumination in the cavity due to the position of the lamp in close profimity to the outside of the cavity wall. By adopting the hole diameter to the wavelength of the microwaves, a complete control of the microwave leakage to the surroundings is obtained. The lighting device is simple and may be produced at low cost and means a negligible infringement on the cavity wall and thereby also a minimum influence on the microwave field distribution in the cavity.

A further improvement of the light distribution in the cavity is obtained in a preferred embodiment of the invention, in which the hole in the cavity wall is covered by a protective glass which is so shaped that it also has the function of a light spreading lens.

Still a further embodiment according to the invention is characterized in that the lighting fitting comprises a reflector enclosing the lamp so as to direct backwardly and sidewardly radiating light from the same substantially in the direction of the hole in the cavity wall.

The hole provided in the cavity wall has a diameter according to the invention which is less than or equal to 25 mm and preferably 14±1 mm.

The hole in the cavity wall is preferably circular with a diameter of 14 mm, the lamp and the reflector also having in this case a circular shape in the plane of the cavity wall, and being combined with a lamp carrier which is fixed by means of a spring holding the reflector pressed against the cavity wall, directly or via said protective glass. The protective glass is adequately provided with a surrounding part having a track which adjoins the edge of the reflector and a central part protruding into the cavity.

BRIEF DESCRIPTION OF THE DRAWINGS

The invention will be described in more detail in the following with reference to the drawing on which a microwave oven is schematically shown in a vertical section through a lighting device arranged in the roof of the oven cavity.

DETAILED DESCRIPTION OF THE PREFERRED EMBODIMENTS

In the figure, 1 refers to the schematically disclosed microwave oven housing, 2 shows the cavity, and 19 shows the microwave source, also schematically.

A cavity roof 3 is provided having a lighting device 4 according to the invention.

The lighting device 4 comprises a circular hole 5 in the cavity roof and a light intensive lamp 6 arranged outside the cavity right in front of the hole 5. In order to guarantee a good light distribution in the cavity through the hole, the lamp is firstly of a smaller diameter than the hole, and secondly is positioned in close connection with the cavity roof.

The lamp is inserted into a lamp socket 7 and is supplied with current through a wire 8 connected to said socket. The lamp socket 7 is combined with a reflector 9 having the task to catch scattered light from the lamp and to direct the same towards the hole 5.

The hole 5 is covered by a protective glass comprising a surrounding part 10 adjoining the outside of the cavity roof, and a central part with a vaulted top 11, which is inserted into the cavity through the hole. The surrounding part 10 has a track 12 in which the front edge 13 of the reflector 9 rests. The inside of the vaulted top 11 is covered with balls 14, being preferably of the same material as the protective glass and providing a light spreading function in combination with the vaulted shape.

The lamp socket 7, the lamp 6, the reflector 9 and the protective glass 10, 11 are fixed by means of a spring 15. The spring 15 is tensioned between two attachments 16, 17, being fixedly connected to the cavity 2 or the housing 1. The spring 15 presses the lamp socket 7 and thereby the edge 13 of the reflector 9 against the track 12 in the protective glass, which is thereby pressed against the outside of the cavity roof 3.

For lamp replacement, the lamp socket 7 is released by releasing the spring 15. The lamp is replaced and thereafter the spring 15 is again fastened. From this it may be concluded that the assembling of the lighting device during manufacture of the oven requires few and simple maneuvers.

The drawing shows the lighting device according to the invention in its natural size. Typically the hole has the diameter 14 mm, the cross section diameter of the lamp being in this case about 8 mm. The distance between the filament 18 of the lamp and the cavity wall is about 7 mm. The lamp, which is preferably a halogen lamp, is operated by an alternating voltage of 6V or 12V. In a lamp of this type the length of the filament is about 3 mm. The short length of the filament contributes to an increased life time of the lamp and an improved mechanical strength and ability to withstand vibrations which are generated by the handling of the microwave over door. A halogen lamp furthermore provides for the desirable temperature resistancy when the lighting device is used in the so called combi-ovens described above.

A hole diameter of 14 mm and other measures in accordance with what has been mentioned above provides for a typical microwave leak of maximum 0,1 $mV/cm^2$, which is clearly below the tolerable limit values and which will not disturb the control electronics of the oven.

Above and in the patent claims the lighting device has been described as comprising one hole and one lamp. Obviously, the same may be comprised in a set of holes and corresponding lamps.

We claim:

1. A microwave oven comprising:

an oven cavity enclosed by a cavity wall, a microwave source for feeding microwave energy of a substantially uniform wavelength into said cavity, a lighting device for illumination of the cavity, said lighting device comprising a single light source arranged at the cavity wall, and a microwave seal substantially preventing leakage of microwaves to the external surroundings of the cavity through said lighting device, said microwave seal comprising a single hole in the cavity wall, said single hole being associated with said single light source in a one-to-one relationship therewith, said single hole selected to be smaller in size in relation to the wavelength of the microwaves which is such that the dimensioning of the hole substantially prevents passage of microwaves through the hole, wherein said single light source comprises a lightintensive lamp positioned outside the cavity, having a short filament and small dimensions relative to the single hole, and being arranged in close proximity to the single hole.

2. A microwave oven as claimed in claim 1, wherein said hole in the cavity is covered by a protective glass which is so shaped that it also functions as a light spreading lens.

3. A microwave oven as claimed in claim 1 wherein the lighting device comprises a reflector enclosing the lamp in order to direct backwardly and sidewardly radiating light from the lamp towards the hole in the cavity wall.

4. A microwave oven as claimed in claim 3, wherein the hole in the cavity wall has a diameter of 14±1 mm.

5. A microwave oven as claimed in claim 1 wherein the hole in the cavity wall is circular and has a diameter which is smaller than 25 mm.

6. A microwave oven as claimed in claim 5, wherein the hole in the cavity wall is circular with a diameter of 14 mm, the lamp and the reflector are circular in the plane of the cavity wall, and are combined by means of a lamp socket, which is fixed by means of a spring keeping the front edge of the reflector pressed against the outside of the cavity wall directly or via a part of the protective glass which surrounds the hole.

7. A microwave oven as claimed in claim 6, wherein the surrounding part of the protective glass is circular and provided with a track for the edge of the reflector, said protective glass comprising a central part which is fitted into the hole, said part having a light spreading vaulted top which is inserted into the cavity.

8. A microwave oven as claimed in claim 1, wherein the lamp is a halogen lamp.

9. A microwave oven as claimed in claim 8, wherein the light source extends through the hole.

10. A microwave oven as claimed in claim 1, wherein the light source extends through the hole.

* * * * *